US010329635B2

(12) United States Patent
Shibata et al.

(10) Patent No.: US 10,329,635 B2
(45) Date of Patent: Jun. 25, 2019

(54) HIGH-STRENGTH COLD-ROLLED STEEL SHEET HAVING EXCELLENT BENDABILITY

(71) Applicant: KOBE STEEL, LTD., Kobe-shi (JP)

(72) Inventors: Kosuke Shibata, Hyogo (JP); Toshio Murakami, Hyogo (JP); Elijah Kakiuchi, Hyogo (JP); Katsura Kajihara, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 617 days.

(21) Appl. No.: 14/765,622

(22) PCT Filed: Feb. 13, 2014

(86) PCT No.: PCT/JP2014/053353
§ 371 (c)(1),
(2) Date: Aug. 4, 2015

(87) PCT Pub. No.: WO2014/129379
PCT Pub. Date: Aug. 28, 2014

(65) Prior Publication Data

US 2015/0368742 A1 Dec. 24, 2015

(30) Foreign Application Priority Data

Feb. 19, 2013 (JP) ..... 2013-030070

(51) Int. Cl.

| | |
|---|---|
| ***C21D 9/46*** | (2006.01) |
| ***C22C 38/06*** | (2006.01) |
| ***C22C 38/16*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C21D 1/84*** | (2006.01) |
| *C21D 1/18* | (2006.01) |

(52) U.S. Cl.
CPC ..... *C21D 9/46* (2013.01); *C21D 1/84* (2013.01); *C21D 8/0205* (2013.01); *C21D 8/0226* (2013.01); *C21D 8/0236* (2013.01); *C21D 8/0247* (2013.01); *C22C 38/001* (2013.01); *C22C 38/002* (2013.01); *C22C 38/02* (2013.01); *C22C 38/04* (2013.01); *C22C 38/06* (2013.01); *C22C 38/16* (2013.01); *C21D 1/18* (2013.01); *C21D 2211/008* (2013.01)

(58) Field of Classification Search
CPC ..... C22C 38/16; C22C 38/06; C22C 38/04
See application file for complete search history.

(56) References Cited

U.S. PATENT DOCUMENTS

| | | | | |
|---|---|---|---|---|
| 2003/0047257 | A1* | 3/2003 | Kami | C21D 8/0273 148/651 |
| 2010/0247957 | A1 | 9/2010 | Hoshika et al. | |
| 2010/0252147 | A1 | 10/2010 | Murakami et al. | |
| 2011/0048589 | A1 | 3/2011 | Matsuda et al. | |
| 2012/0009434 | A1* | 1/2012 | Hata | C21D 6/008 428/577 |
| 2013/0048151 | A1 | 2/2013 | Kawamura et al. | |
| 2014/0322559 | A1* | 10/2014 | Becker | C21D 1/19 428/659 |
| 2014/0377584 | A1* | 12/2014 | Hasegawa | C23C 2/06 428/659 |
| 2016/0304981 | A1* | 10/2016 | Song | C22C 38/40 |

FOREIGN PATENT DOCUMENTS

| | | | | |
|---|---|---|---|---|
| CN | 101932745 | A | | 12/2010 |
| EP | 2 216 422 | A1 | | 8/2010 |
| JP | 7-90488 | A | | 4/1995 |
| JP | 2006183140 | A | * | 7/2006 |
| JP | 2009-203549 | A | | 9/2009 |
| JP | 4324226 | B1 | * | 9/2009 |
| JP | 2009-287102 | A | | 12/2009 |
| JP | 2010018862 | A | * | 1/2010 |
| JP | 2010-215958 | A | | 9/2010 |
| JP | 2010-236053 | A | | 10/2010 |
| JP | 2010-242164 | A | | 10/2010 |
| JP | 2010-248565 | A | | 11/2010 |
| JP | 2011-179030 | A | | 9/2011 |
| JP | 2011-219784 | A | | 11/2011 |

(Continued)

OTHER PUBLICATIONS

Machine English Translation of JP 2010-018862 (Year: 2010).*
Machine English Translation of JP 43-24226 (Year: 2009).*
International Search Report and Written Opinion dated May, 13, 2014 in PCT/JP2014/053353 filed Feb. 13, 2014 (with English language translation).
Extended European Search Report dated Sep. 1, 2016 in Patent Application No. 14754292.2.

*Primary Examiner* — Veronica F Faison
(74) *Attorney, Agent, or Firm* — Oblon, McClelland, Maier & Neustadt, L.L.P.

(57) ABSTRACT

A high strength cold-rolled steel sheet has a component composition containing specific amounts of C, Si, Mn, P, S, N and Al, respectively with a remainder being iron and inevitable impurities. The steel sheet contains 95% or more of martensite in terms of area ratio, and contains 5% or less (inclusive of 0%) of residual austenite and ferrite in terms of a total area ratio. An average size of a carbide is 60 nm or less in terms of an equivalent circle diameter, and a number density of the carbide having the equivalent circle diameter of 25 nm or more is $5.0\times10^5$ pieces or less per $mm^2$. The steel sheet has a yield strength of 1,180 MPa or more and a tensile strength of 1,470 MPa or more.

14 Claims, No Drawings

(56) References Cited

FOREIGN PATENT DOCUMENTS

| | | | | | |
|---|---|---|---|---|---|
| JP | 2013-104081 | A | | 5/2013 | |
| KR | 10-2010-0070375 | A | | 6/2010 | |
| WO | WO-2012156428 | A1 | * | 11/2012 | ..... C21D 1/19 |
| WO | WO-2015088514 | A1 | * | 6/2015 | ..... C22C 38/40 |

* cited by examiner

HIGH-STRENGTH COLD-ROLLED STEEL SHEET HAVING EXCELLENT BENDABILITY

TECHNICAL FIELD

The present invention relates to a high strength cold-rolled steel sheet excellent in workability, which is used for automobile components and the like, and in detail, to a high strength cold-rolled steel sheet having a yield strength of 1,180 MPa or more and a tensile strength of 1,470 MPa or more and excellent particularly in bendability among the workability.

BACKGROUND ART

High strength is required for steel sheets to be generally used for automobile framework components and the like for the purpose of collision safety, fuel consumption reduction due to reduction in car body weight and the like, and excellent press formability is also required in order to work them into the framework components that are complex in shape. Further, material designing on the basis of only tensile strength (TS) has conventionally been executed. However, when collision safety is taken in consideration, material designing on the basis of yield strength (YP) becomes necessary. Accordingly, a high strength steel sheet also excellent in the yield strength (YP) in addition to the tensile strength (TS) and excellent in workability has become demanded.

For this reason, it has been earnestly desired to provide, for example, a high strength steel sheet having a yield strength (YP) of 1,180 MPa or more and a tensile strength (TS) of 1,470 MPa or more and having a bendability (critical bending radius/sheet thickness: R/t) of 2.4 or less (preferably 2.1 or less, and more preferably 1.5 or less).

In consideration of such needs as described above, there have been proposed many high-strength steel sheets improved in bendability, on the basis of various ideas for component designing and structure control. However, there are still few ones in which all of the yield strength, the tensile strength and the bendability satisfy such desired levels as described above, at the present stage.

For example, Patent Document 1 discloses a high tensile strength cold-rolled steel sheet substantially composed of a single-phase microstructure of martensite, and in the steel sheet having a tensile strength of 1,470 MPa or more, a bendability (critical bending radius/sheet thickness: R/t) of 1.5 or less is obtained in a bending test by a three-point bending method. Also, there is only one example in which the tensile strength is 1,470 MPa or more, the yield strength is 1,180 MPa or more and the above-mentioned bendability is 0.75 (see Table 3, No. 8). However, in all of these examples, Ti and Nb are added in order to increase strength, particularly the yield strength, and in the above-mentioned example No. 8, B is further added in addition to these. Accordingly, Ti and Nb are essential for ones described in the document, and it is considered that the bendability is necessarily deteriorated by carbides produced by addition of these elements. It is therefore unlikely to obtain the bendability satisfying the demands described above by a V-block method that is a severer evaluation method.

Patent Document 2 discloses a high tensile strength steel sheet composed of a dual-phase microstructure of 25 to 75% of ferrite in terms of area ratio with the remainder being tempered martensite, and the bendability (critical bending radius/sheet thickness: R/t) of 2.4 or less is obtained by a test method in accordance with JIS Z 2248. However, 25% or more of ferrite as a soft phase is contained, so that a tensile strength of 1,470 MPa or more is not satisfied as shown in the examples thereof, and from the level of the tensile strength, it is presumed that the yield strength will be of course less than 1,180 MPa.

Patent Document 3 partially discloses the high tensile strength steel sheets having a tensile strength of 1,470 MPa or more and satisfying a bendability (critical bending radius/sheet thickness: R/t) of 2.4 or less in a bending test by a U-bending method, targeting a tensile strength of 980 MPa or more in the examples thereof. However, it is unlikely to obtain the bendability satisfying the demands described above by the V-block method that is a severer evaluation method. Moreover, the workability is enhanced by precipitating carbides in large amounts, so that the C solid solution amount is small. Further, the area ratio of soft ferrite is large. Accordingly, the yield strength (YP: indicated as YS in the same document) is in the level of at most 1,100 MPa or less, and does not satisfy the requirement of 1,180 MPa or more.

PRIOR ART DOCUMENTS

Patent Documents

Patent Document 1: JP-A-2010-215958
Patent Document 2: JP-A-2011-219784
Patent Document 3: JP-A-2009-287102

SUMMARY OF THE INVENTION

Problems that the Invention is to Solve

Therefore, an object (problem) of the present invention is to provide a high strength cold-rolled steel sheet excellent in bendability, which has a yield strength (YP) of 1,180 MPa or more and a tensile strength (TS) of 1,470 MPa or more and has a minimum bending radius (critical bending radius)/sheet thickness according to a V-block method bending test of 2.4 or less, in a martensite single-phase steel as a steel component free from Ti, Nb and V, which are strength improving elements, and a method for manufacturing the same.

Solution for Solving the Problems

The invention described in claim 1 is directed to a high strength cold-rolled steel sheet excellent in bendability, having a component composition comprising, by mass %:

C: 0.15 to 0.30%;
Si: 1.0 to 3.0%;
Mn: 0.1 to 5.0%;
P: 0.1% or less (exclusive of 0%);
S: 0.010% or less (exclusive of 0%);
N: 0.01% or less (exclusive of 0%); and
Al: 0.001 to 0.10%, with a remainder being iron and inevitable impurities, wherein the high strength cold-rolled steel sheet contains 95% or more of martensite in terms of area ratio, and contains 5% or less (inclusive of 0%) of residual austenite and ferrite in terms of a total area ratio, an average size of a carbide is 60 nm or less in terms of an equivalent circle diameter, and a number density of the carbide having the equivalent circle diameter of 25 nm or more is $5.0\times10^5$ pieces or less per $mm^2$, and the high strength cold-rolled steel sheet has a yield strength of 1,180 MPa or more and a tensile strength of 1,470 MPa or more.

The invention described in claim 2 is directed to the high strength cold-rolled steel sheet excellent in bendability according to claim 1, wherein an average grain size of prior austenite in the martensite is 6 μm or less.

The invention described in claim 3 is directed to the high strength cold-rolled steel sheet excellent in bendability according to claim 1 or 2, wherein the component composition further comprises one kind or two or more kinds of:

Cu: 0.05 to 1.0%;

Ni: 0.05 to 1.0%; and

B: 0.0002 to 0.0050%.

The invention described in claim 4 is directed to a method for manufacturing the high strength cold-rolled steel sheet excellent in bendability according to any one of claims 1 to 3, the method comprising: holding a steel sheet, which has been obtained by subjecting a steel slab satisfying the component composition to hot rolling and cold rolling, for 30 s or more and 1,200 s or less after heating at an Ac3 point or more and 930° C. or less; then executing rapid cooling to room temperature at a rate of 100° C./s or more; and further executing a heat treatment of holding at 240° C. or less for 300 s or less, wherein the high strength cold-rolled steel sheet has a yield strength of 1,180 MPa or more and a tensile strength of 1,470 MPa or more.

The invention described in claim 5 is directed to the method for manufacturing the high strength cold-rolled steel sheet according to claim 4, wherein the steel sheet which has been subjected to cold rolling is held at the Ac3 point or more and 930° C. or less for 30 s or more and 1,200 s or less before the heat treatment, and thereafter the steel sheet is rapidly cooled to room temperature at a rate of 100° C./s or more.

Advantageous Effects of the Invention

According to the present invention, it is possible to provide a high strength cold-rolled steel sheet excellent in bendability, which has high strength such as a yield strength (YP) of 1,180 MPa or more and a tensile strength (TS) of 1,470 MPa or more and has extremely high bendability such as a minimum bending radius (critical bending radius)/sheet thickness according to a V-block method bending test of 2.4 or less, by properly controlling a precipitation state of carbides in a martensite single-phase steel without adding special elements such as Ti and Nb.

EMBODIMENTS FOR CARRYING OUT THE INVENTION

The present invention has been developed after intensive studies for obtaining a high strength cold-rolled steel sheet excellent in bendability, in a martensite single-phase steel as a steel component free from Ti, Nb and V. That is to say, it has been found that reduction in starting points of fracture and suppression of development thereof are executed by controlling a precipitation state of carbides to improve the bendability, and based on this finding, the present invention has been completed. Also, "excellent in bendability" in the present invention means that the minimum bending radius (critical bending radius)/sheet thickness is 2.4 or less, at which when 90° bending work is executed by a V-block method in such a manner that a rolling direction of a steel sheet agrees with a bending ridge, the material can be subjected to bending work without breakage.

First, the microstructure characterizing the steel sheet in the present invention will be described below.

<Martensite: 95% or More in Terms of Area Ratio>

In the present invention, it is an important requirement that a microstructure is a martensite single phase. By making the microstructure the martensite single phase, high strength can be realized, and the microstructure is uniform compared with a dual-phase microstructure, so that cracks are less likely to occur at the time of deformation, which can increase the workability. However, when the area ratio of residual austenite and ferrite is 5% or less, the strength and the workability are not influenced. Accordingly, the area ratio of martensite is made 95% or more.

<The Average Size of Carbides is 60 nm or Less in Terms of Equivalent Circle Diameter, and the Number Density of Carbides Having an Equivalent Circle Diameter of 25 nm or More is $5.0\times10^5$ Pieces or Less Per $mm^2$>

Coarse carbides having an equivalent circle diameter of 60 nm or more act as starting points of fracture at the time of deformation, and promote propagation of the fracture to decrease the workability. For this reason, the average size of carbides is made 60 nm or less in terms of equivalent circle diameter. Further, even when the average size of carbides is 60 nm or less in terms of equivalent circle diameter, in the case where the number density of carbides having an equivalent circle diameter of 25 nm or more is too high, the occurrence frequency of minute cracks increases at the time of deformation. This becomes therefore a factor for deteriorating the workability. However, fine carbides having an equivalent circle diameter of less than 25 nm do not act as starting points of fracture at the time of deformation, and do not have a large influence on the bendability. Further, solid solution C is decreased by precipitation of carbides, and the solid solution strengthening amount is decreased. On the other hand, in the case of fine carbides, the precipitation strengthening amount is increased, so that the strength is not largely influenced. For this reason, the number density of carbides having an equivalent circle diameter of 25 nm or more is $5.0\times10^5$ pieces or less per $mm^2$, preferably $1.0\times10^4$ pieces or less per $mm^2$ and more preferably 0.

In the microstructure in the present inventive steel sheet, the above requirements are essential requirements. However, it is further desirable to satisfy the following recommended requirement.

<The Average Grain Size of Prior Austenite is 6 μm or Less>

The finer the prior austenite grain size is, the finer the microstructure of martensite formed during quenching becomes, and fracture becomes less likely to occur during bending forming. The bendability is therefore improved. For this reason, the average grain size of prior austenite is 6 μm or less and preferably 5 μm or less.

Measuring methods for the area ratio of each phase, the size of precipitates and the existence density thereof will be described below.

[Measurement of Area Ratio of Each Phase]

First, with respect to the area ratio of each phase, after each specimen steel sheet was mirror-polished and corroded by a 3% nital solution to expose the metal microstructure, a scanning electron microscope (SEM) image of 2,000 magnifications was observed with respect to 5 fields of view of approximately 40 μm×30 μm region, thereby identifying a tempered martensite phase. The area ratio of each region was calculated, defining the region other than the tempered martensite phase as residual austenite and ferrite.

[Measuring Method for the Size of Precipitates and the Existence Density Thereof]

With respect to the size of cementite and the number density thereof, an extraction replica sample of each specimen steel sheet was prepared, and a transmission type electron microscope (TEM) image of 10,000 magnifications was observed with respect to 3 fields of view of approximately 8 μm×7 μm region.

Then, from contrast of the image, a white portion was determined as cementite grains and marked, the equivalent circle diameter D ($D=2\times(A/\pi)^{1/2}$) was calculated from the area A of each marked cementite grain described above, using an image-analysis software program, to determine the average value, and the number of the cementite grains present in a unit area, which have a predetermined size, was determined.

[Measuring Method for the Average Grain Size of Prior Austenite]

Further, with respect to the grain size of prior austenite grains in the martensite microstructure, after each specimen steel sheet was mirror-polished and subjected to a corrosion treatment with a corrosion solution that preferentially corrodes a prior austenite grain boundary, the grain size of prior austenite was measured by a method described in JIS G 0551, with respect to a field of view (200 μm×150 μm) observed under an optical microscope, and the average grain size was calculated from the grain size number.

Next, the component composition constituting the steel sheet in the present invention will be described. Hereinafter, all units of the chemical components are mass %.

[Component Composition of the Steel Sheet in the Present Invention]

C: 0.15 to 0.30%

C is an important element largely affecting the strength of the steel sheet. When the C content is less than 0.15%, even the martensite single-phase steel cannot secure a tensile strength of 1,470 MPa. On the other hand, when it exceeds 0.30%, coarse carbides become liable to precipitate during tempering to deteriorate the bendability. Also from the viewpoint of securing weldability, the lower C content is desirable, so that the upper limit thereof is 0.30%. It is preferably 0.25% or less.

Si: 1.0 to 3.0%

Si is a useful element having an effect of suppressing coarsening of the carbide grains during tempering, contributing to an improvement in bendability, and also contributing to an increase in yield strength of the steel sheet as a solid solution strengthening element. When the addition amount thereof is small, martensitic transformation occurs during quenching, and at the same time, carbides sometimes precipitate, which causes a decrease in bendability in some cases. Further, when the Si content exceeds 3.0%, the weldability is significantly decreased. It is therefore made 1.0 to 3.0%. It is preferably 2.5% or less.

Mn: 0.1 to 5.0%

Mn is a useful element having an effect of suppressing coarsening of cementite in tempering similarly to Si described above, contributing to an improvement in bendability, and also contributing to an increase in yield strength of the steel sheet as a solid solution strengthening element. Further, there is also an effect of widening the range of the manufacturing conditions for obtaining martensite by enhancing hardenability during quenching. When the content is less than 0.1%, the effects described above cannot be sufficiently exerted, so that the bendability and a tensile strength of 1,470 MPa are not compatible with each other. On the other hand, when it exceeds 5.0%, deterioration of casting performance is induced. Accordingly, the range of the Mn content is 0.1 to 5.0%. The lower limit is preferably 0.5% and more preferably 1.2%, and the upper limit is preferably 2.5% and more preferably 2.2%.

P: 0.1% or less (exclusive of 0%)

P inevitably exists as an impurity element and contributes to an increase in strength by solid solution strengthening. However, it deteriorates the bendability by segregating on the prior austenite grain boundary and embrittling the grain boundary. The content is therefore 0.1% or less. It is preferably 0.05% or less and more preferably 0.03% or less.

S: 0.010% or less (exclusive of 0%)

S also inevitably exists as an impurity element and deteriorates the bendability by forming MnS inclusions, which become starting points of cracks at the time of bending deformation, so that the content is 0.010% or less. It is preferably 0.005% or less and more preferably 0.003% or less.

N: 0.01% or less (exclusive of 0%)

N also inevitably exists as an impurity element and deteriorates the workability of the steel sheet by strain aging, so that the content is preferably as small as possible, and is 0.01% or less.

Al: 0.001 to 0.10%

Al is a useful element added as a deoxidizing element. However, when the content is less than 0.001%, the steel cleaning action is not sufficiently obtained. On the other hand, when it exceeds 0.10%, the steel craning action is deteriorated. The range of the Al content is 0.001 to 0.10%.

The steel in the present invention basically contains the components described above, and the remainder is substantially iron and impurities. However, other than the above, the following allowable components can be added within a range not impairing the action of the present invention.

One kind or two or more kinds of

Cu: 0.05 to 1.0%,

Ni: 0.05 to 1.0% and

B: 0.0002 to 0.0050%

These elements are elements useful for increasing the strength by enhancing the hardenability during quenching and contributing to securement of the martensite area ratio. When the respective elements are added in an amount of less than the respective lower limit values described above, the actions as described above cannot be effectively exerted. On the other hand, when they are added in an amount exceeding the upper limit values described above, austenite remains during quenching to form martensite at the time of deformation, thereby generating voids at an interface between soft ferrite and a hard phase. The bendability is therefore deteriorated.

Manufacturing conditions of the high strength steel sheet in the present invention will be described below.

In the present invention, a manufacturing method is characterized by hot rolling of a slab and heat treatment after cold rolling. For this reason, with respect to a manufacturing method until the hot rolling and cold rolling, a conventionally known manufacturing method can be employed.

[Annealing Conditions]

With respect to annealing conditions, after heating at the Ac3 point or more and 930° C. or less, holding is executed for 30 s or more and 1200 s or less, and then, rapid cooling is executed at a rate of 100° C./s or more to room temperature.

<Holding for 30 s or More and 1200 s or Less after Heating at the Ac3 Point or More and 930° C. Or Less>

In the present invention, it is an important requirement that the steel sheet is the martensite single-phase microstructure. In order to obtain the martensite single-phase microstructure, the microstructure before quenching is required to be an austenite single-phase microstructure. It is therefore necessary to adjust the annealing heating temperature to the Ac3 point or more. Here, the Ac3 point can be calculated from chemical components of the steel sheet using the following formula (1) described in Leslie, "The Physical Metallurgy of Steels", translated by KOHDA Shigeyasu, Maruzen Company, Limited (1985), p.273.

$$Ac3(^\circ C.)=910-203\times\sqrt{C}-15.2\times Ni+44.7\times Si-30\times Mn-20\times Cu+700\times P+400\times Al+400\times Ti \quad (1)$$

wherein an element symbol in the above formula represents the content (mass %) of each element.

Further, when the annealing heating temperature exceeds 930° C., the austenite grain size is coarsened to sometimes cause deterioration of the bendability. For this reason, the range of the annealing heating temperature is the Ac3 point or more and 930° C. or less. Also, when the holding time at the Ac3 point or more is less than 30 s, the martensite single-phase microstructure is not obtained after quenching, because austenitic transformation is not completed. When it exceeds 1,200 s, heat treatment cost is increased to cause significant deterioration of productivity. For this reason, the holding time is 30 s or more and 1,200 s or less.

<Rapid Cooling at a Rate of 100° C./s or More to Room Temperature>

In order to suppress the formation of ferrite and bainite during cooling to obtain the martensite single-phase microstructure, and in order to suppress the precipitation of coarse carbides after the formation of martensite, rapid cooling is executed at a rate of 100° C./s or more to room temperature.

[Tempering Conditions]

Tempering is executed by holding at 240° C. or less for 300 s or less.

<Holding at 240° C. Or Less for 300 s or Less>

When the tempering heating temperature is too high, or when tempering is executed for a long time, either or both of deterioration of the bendability caused by coarsening of carbides and insufficient strength caused by insufficient solid solution C content due to the occurrence of excessive precipitation are generated. For this reason, the tempering heating temperature is 240° C. or less and preferably 220° C. or less, and the holding time is 300 s or less and preferably 200 s or less. Further, mobile dislocation introduced during the martensitic transformation is introduced in large amounts in quenched martensite, and the yield strength can be further increased by firmly fixing C to the mobile dislocation by performing tempering. For this reason, the tempering heating temperature is preferably 100° C. or more and more preferably 150° C. or more.

Further, in the manufacturing method in the present invention, before a series of heat treatments described above from the annealing of the cold-rolled steel sheet to the tempering, namely, before the start of the annealing, rapid cooling can be executed to the cold-rolled steel sheet at a rate of 100° C./s or above to room temperature after holding at the Ac3 point or more and 930° C. or less for 30 s or more and 1,200 s or less. The steel sheet becomes the martensite single-phase microstructure by this heat treatment. Martensite has a fine microstructure in which many packets and blocks are formed in the inside of prior austenite, so that many nucleation sites are present during the heat treatment to be subsequently executed. Accordingly, a fine austenite microstructure is obtained. For miniaturization of the prior austenite grain size, a technique of adding elements such as Ti and V and impeding grain growth with carbides formed is generally employed. However, as described above, the carbides deteriorate the bendability. In the present invention, therefore, a technique of using no carbide forming element has been employed for miniaturization of the prior austenite grains.

[Prior γ Grain Size Miniaturization Heat Treatment]

<Holding for 30 s or More and 1,200 s or Less after Heating at the Ac3 Point or More and 930° C. Or Less>

When austenite before quenching is miniaturized by the technique described above, first, the cold-rolled steel sheet is required to be the martensite single-phase microstructure, and it is necessary to achieve a microstructure where many nucleation sites are present. In order to obtain the martensite single-phase microstructure, the microstructure before quenching is required to be the austenite single-phase microstructure. The annealing heating temperature is therefore the Ac3 point or more. Further, when the annealing heating temperature exceeds 930° C., the austenite grain size is coarsened to fail to obtain the fine martensite microstructure after quenching. For this reason, the range of the annealing heating temperature is the Ac3 point or more and 930° C. or less. Also, when the holding time at the Ac3 point or more is less than 30 s, the martensite single-phase microstructure is not obtained after quenching, because austenitic transformation is not completed. When it exceeds 1,200 s, heat treatment cost is increased to cause significant deterioration of productivity. The holding time is therefore 30 s or more and 1,200 s or less.

<Rapid Cooling at a Rate of 100° C./s or More to Room Temperature>

In order to suppress the formation of ferrite and bainite during cooling to obtain the martensite single-phase microstructure, rapid cooling is executed at a rate of 100° C./s or more to room temperature.

Examples

Steels having components shown in Table 1 were smelted, to prepare ingots having a thickness of 120 mm. These were hot-rolled to have a thickness of 2.8 mm. After pickled, these were cold-rolled to have a thickness of 1.4 mm to prepare specimens. Heat treatments were executed under the annealing conditions and tempering conditions shown in Table 2. Further, some steel types were subjected to a heat treatment for miniaturization of the prior γ grain size before annealing. Also, the conforming steel in the remarks column of Table 1 is a steel satisfying the component range specified in the present invention, and the comparative steel is a steel not satisfying the component range and indicated by underlining the corresponding component value that becomes out of the range. Further, one in which the annealing conditions and tempering conditions shown in Table 2 do not satisfy the manufacturing conditions specified in the present invention is indicated by underlining the corresponding condition value.

With respect to the respective steels after the heat treatments, the average size of martensite, residual austenite and precipitates and the existence density thereof were measured by the measuring methods described in the section of "Embodiments for Carrying Out the Invention" described above.

Further, with respect to the above-mentioned respective steel sheets, the tensile strength TS, the yield strength YP and the critical bending radius R were measured. Also, with respect to the tensile strength TS and the yield strength YP, a No. 5 specimen described in JIS Z 2201 was prepared taking a longitudinal axis thereof in a direction perpendicular to a rolling direction, and measurement was executed according to JIS Z 2241. Further, with respect to the critical bending radius R, a specimen of 30 mm wide×35 mm long was prepared taking a longitudinal axis thereof in a direction perpendicular to a rolling direction, similarly to the above, and after one side surface thereof was ground by 0.2 mm, a bending test was executed by a V-block method in accordance with JIS Z 2248, in such a manner that the ground surface did not come into contact with a punch. The bending radius at that time was variously changed to 0 to 5 mm, and the minimum bending radius was determined at which the material could be subjected to bending work without breakage. Defining this as the critical bending radius, critical bending radius/sheet thickness: R/t was calculated.

The microstructure, mechanical properties and the like of the respective steel sheets based on these measurement results are shown in Table 3.

In the judgment column of the Table 3, one whose measurement values of the mechanical properties corresponds to YP≥1,180 MPa, TS≥1,470 MPa and R/t≤1.5 is defined as ⊙, one whose values corresponds to YP≥1,180 MPa, TS≥1,470 MPa and R/t≤2.4 is defined as ○, and one whose values corresponds to any one of YP<1,180 MPa, TS<1,470 MPa and R/t>2.4 is defined as x. Also, one whose microstructure and measurement values of the mechanical properties do not satisfy the range and conditions specified in the present invention is indicated by underlining the value.

TABLE 1

| Steel | Component (mass %) | | | | | | | | | | | Ac3 | |
|---|---|---|---|---|---|---|---|---|---|---|---|---|---|
| Type | C | Si | Mn | P | S | N | Al | Ti | Nb | Cu | B | (° C.) | Remarks |
| A | 0.170 | 1.35 | 2.00 | 0.010 | 0.001 | 0.0040 | 0.040 | — | — | — | — | 850 | Conforming steel |
| B | 0.210 | 1.35 | 2.00 | 0.010 | 0.001 | 0.0040 | 0.040 | — | — | — | — | 840 | Conforming steel |
| C | 0.15 | 1.35 | 2.00 | 0.010 | 0.001 | 0.0040 | 0.040 | — | — | — | — | 855 | Conforming steel |
| D | 0.170 | 1.35 | 1.2 | 0.010 | 0.001 | 0.0040 | 0.040 | — | — | 0.5 | — | 868 | Conforming steel |
| E | 0.170 | 1.35 | 1.2 | 0.010 | 0.001 | 0.0040 | 0.040 | — | — | — | 0.003 | 874 | Conforming steel |
| F | 0.170 | 0.20 | 2.00 | 0.010 | 0.001 | 0.0040 | 0.040 | — | — | — | — | 798 | Comparative steel |
| G | 0.100 | 1.35 | 2.00 | 0.010 | 0.001 | 0.0040 | 0.040 | — | — | — | — | 869 | Comparative steel |
| H | 0.170 | 1.35 | 2.00 | 0.010 | 0.001 | 0.0040 | 0.040 | 0.014 | 0.016 | — | — | 855 | Comparative steel |

TABLE 2

| | | Prior γ grain size miniaturization heat treatment | | | Annealing Condition | | | Tempering Condition | | |
|---|---|---|---|---|---|---|---|---|---|---|
| Manufacturing No. | Steel Type | Annealing Heating Temperature (° C.) | Holding Time (s) | Cooling Rate to Ms Point or less (° C./s) | Annealing Heating Temperature (° C.) | Holding Time (s) | Cooling Rate to Ms Point or less (° C./s) | Tempering Heating Temperature (° C.) | Holding Time (s) | Remarks |
| 1 | A | — | — | — | 880 | 90 | >1000 | 200 | 180 | Example |
| 2 | A | — | — | — | 900 | 90 | >1000 | 100 | 180 | Example |
| 3 | A | — | — | — | 880 | 90 | >1000 | 300 | 180 | Comparative Example |
| 4 | A | — | — | — | 900 | 180 | >1000 | 265 | 0 | Comparative Example |
| 5 | A | — | — | — | 900 | 180 | >1000 | 200 | 1800 | Comparative Example |
| 6 | A | — | — | — | 900 | 90 | >1000 | 200 | 180 | Example |
| 7 | A | — | — | — | 900 | 90 | >1000 | 250 | 180 | Comparative Example |
| 8 | A | 900 | 90 | >100 | 900 | 90 | >1000 | 200 | 180 | Example |
| 9 | B | — | — | — | 900 | 90 | >1000 | 200 | 180 | Example |
| 10 | C | — | — | — | 900 | 20 | >1000 | 200 | 180 | Comparative Example |
| 11 | D | — | — | — | 900 | 90 | >1000 | 200 | 180 | Example |
| 12 | E | — | — | — | 900 | 90 | >1000 | 200 | 180 | Example |
| 13 | F | — | — | — | 900 | 90 | >1000 | 200 | 180 | Comparative Example |
| 14 | F | — | — | — | 900 | 90 | >1000 | 250 | 180 | Comparative Example |
| 15 | G | — | — | — | 900 | 90 | >1000 | — | — | Comparative Example |
| 16 | G | — | — | — | 900 | 90 | >1000 | 200 | 180 | Comparative Example |
| 17 | H | — | — | — | 900 | 90 | >1000 | 200 | 180 | Comparative Example |

TABLE 3

| Manufacturing No. | Steel Type | Microstructure: Area Ratio (%) M | Area Ratio (%) α + Residual γ | Average Size of Carbides (nm) | Number Density of Carbides (pieces/mm$^2$) | Prior γ Grain Size (μm) | Mechanical Property: YP (MPa) | TS (MPa) | R/t | Judgment | Remarks |
|---|---|---|---|---|---|---|---|---|---|---|---|
| 1 | A | 100 | 0 | 0 | 0 | 6.1 | 1277 | 1541 | 2.1 | ○ | Example |
| 2 | A | 100 | 0 | 0 | 0 | 6.3 | 1222 | 1630 | 2.1 | ○ | Example |
| 3 | A | 100 | 0 | 110 | $6.2 \times 10^6$ | 6.1 | 1327 | 1480 | 2.9 | X | Comparative Example |
| 4 | A | 100 | 0 | 71 | $4.5 \times 10^6$ | 6.8 | 1304 | 1536 | 3.3 | X | Comparative Example |
| 5 | A | 100 | 0 | 59 | $8.9 \times 10^5$ | 6.8 | 1291 | 1509 | 2.5 | X | Comparative Example |
| 6 | A | 100 | 0 | 0 | 0 | 6.3 | 1291 | 1540 | 2.1 | ○ | Example |
| 7 | A | 100 | 0 | 92 | $1.2 \times 10^6$ | 6.3 | 1296 | 1508 | 2.5 | X | Comparative Example |
| 8 | A | 100 | 0 | 0 | 0 | 4.5 | 1289 | 1560 | 1.4 | ⊙ | Example |
| 9 | B | 97 | 3 | 0 | 0 | 6.3 | 1210 | 1471 | 1.7 | ○ | Example |
| 10 | C | 90 | 10 | 0 | 0 | 6.1 | 942 | 1502 | 2.1 | X | Comparative Example |
| 11 | D | 100 | 0 | 0 | 0 | 6.2 | 1198 | 1587 | 1.7 | ○ | Example |
| 12 | E | 100 | 0 | 0 | 0 | 6.2 | 1209 | 1611 | 1.7 | ○ | Example |
| 13 | F | 100 | 0 | 68 | $3.8 \times 10^6$ | 8.5 | 1243 | 1480 | 2.9 | X | Comparative Example |
| 14 | F | 100 | 0 | 82 | $7.8 \times 10^6$ | 8.5 | 1254 | 1418 | 3.3 | X | Comparative Example |
| 15 | G | 95 | 5 | 0 | 0 | 6.4 | 997 | 1304 | 1.7 | X | Comparative Example |
| 16 | G | 95 | 5 | 0 | 0 | 6.4 | 1080 | 1295 | 1.7 | X | Comparative Example |
| 17 | H | 100 | 0 | 25 | $7.4 \times 10^5$ | 5.2 | 1296 | 1572 | 2.5 | X | Comparative Example |

From the results of Table 3, it is evident that according to Examples of the present invention, the cold-rolled steel sheets excellent in bendability are obtained, which have high strength such as a yield strength (YP) of 1,180 MPa or more and a tensile strength (TS) of 1,470 MPa or more and have a critical bending radius/sheet thickness (R/t) of 2.4 or less.

As shown in Table 3, in all of Nos. 1, 2, 6 and 8, which are working examples, the yield strength was 1,180 MPa or more, the tensile strength was 1,470 MPa or more, and R/t satisfied 2.1 or less. There were obtained the high strength cold-rolled steel sheets excellent in bendability satisfying the desired levels described in the section of "Background Art" described above.

Also, of the inventive steels described above, steel No. 8 (evaluated as ⊙) also fulfills that "the average grain size of prior austenite is 6 μm or less", which is the recommended requirement of microstructure requirements, and satisfies the higher desired levels described in the section of "Background Art" described above.

On the other hand, Nos. 3 to 5, 7, 10 and 13 to 17, which are comparative examples, are inferior in at least any of YP, TS and R/t.

For example, in Nos. 3 to 5 and 7, the tempering conditions are out of the recommended range, thereby not satisfying at least one of the requirements that specify the microstructure in the present invention. R/t is therefore inferior.

Nos. 13 and 14 do not contain Si in an amount of 1.0% or more, so that coarse carbides are formed during tempering. R/t is therefore inferior.

Nos. 15 and 16 do not contain C in an amount of 0.15% or more, so that the strength of tempered martensite is not sufficient. YP and TS are therefore inferior.

In No. 17, Ti and Nb, which are carbide-forming elements, are added, so that carbides are formed in large amounts. R/t is therefore inferior.

Although the present invention has been described in detail referring to specific embodiments, it is obvious for a person with an ordinary skill in the art that various alterations and amendments can be effected without departing from the spirit and range of the present invention.

The present application is based on Japanese Patent Application No. 2013-030070 filed on Feb. 19, 2013, the contents of which are hereby incorporated by reference.

INDUSTRIAL APPLICABILITY

The high strength cold-rolled steel sheet in the present invention has a yield strength of 1,180 MPa or more and a tensile strength of 1,470 MPa or more, is excellent particularly in bending workability, and is useful for automobile framework components.

The invention claimed is:

1. A high strength cold-rolled steel sheet, having a component composition comprising, by mass %:

C: 0.15 to 0.30%;
Si: 1.0 to 3.0%;
Mn: 0.1 to 5.0%;
P: more than 0% and 0.1% or less;
S: more than 0% and 0.010% or less;
N: more than 0% and 0.01% or less;
Al: 0.001 to 0.10%; and
iron,
wherein
the component composition of the high strength cold-rolled steel sheet is free from V, the high strength cold-rolled steel sheet contains, in terms of area ratio, 95% or more of martensite, and 5% or less of a total of residual austenite and ferrite, an average size of a carbide is 60 nm or less in terms of an equivalent circle diameter, and a number density of the carbide having an equivalent circle diameter of 25 nm or more is $5.0\times10^5$ pieces or less per $mm^2$, and the high strength cold-rolled steel sheet has a yield strength of 1,180 MPa or more and a tensile strength of 1,470 MPa or more.

2. The high strength cold-rolled steel sheet according to claim 1, wherein an average grain size of prior austenite in the martensite is 6 μm or less.

3. The high strength cold-rolled steel sheet according to claim 1, wherein the component composition further comprises: at least one of:

Cu: 0.05 to 1.0%;

Ni: 0.05 to 1.0%; and

B: 0.0002 to 0.0050%.

4. A method for manufacturing the high strength cold-rolled steel sheet according to claim 1, the method comprising:

(i) holding a steel sheet obtained by subjecting a steel slab satisfying the component composition to hot rolling and cold rolling, for 30 s or more and 1,200 s or less after heating at an Ac3 point or more and 930° C. or less;

(ii) then executing rapid cooling to room temperature at a rate of 100° C./s or more; and (iii) further holding at 240° C. or less for 300 s or less.

5. The method according to claim 4, further comprising: before said holding (i), (iv) holding the steel sheet which has been subjected to the cold rolling at the Ac3 point or more and 930° C. or less for 30 s or more and 1,200 s or less, and (v) thereafter rapidly cooling the steel sheet to room temperature at a rate of 100° C./s or more.

6. The high strength cold-rolled steel sheet according to claim 2, wherein the component composition further comprises: at least one of:

Cu: 0.05 to 1.0%;

Ni: 0.05 to 1.0%; and

B: 0.0002 to 0.0050%.

7. A method for manufacturing the high strength cold-rolled steel sheet according to claim 2, the method comprising:

(i) holding a steel sheet, which has been obtained by subjecting a steel slab satisfying the component composition to hot rolling and cold rolling, for 30 s or more and 1,200 s or less after heating at an Ac3 point or more and 930° C. or less;

(ii) then executing rapid cooling to room temperature at a rate of 100° C./s or more;

(iii) further executing a heat treatment of holding at 240° C. or less for 300 s or less.

8. A method for manufacturing the high strength cold-rolled steel sheet according to claim 3, the method comprising:

(i) holding a steel sheet, which has been obtained by subjecting a steel slab satisfying the component composition to hot rolling and cold rolling, for 30 s or more and 1,200 s or less after heating at an Ac3 point or more and 930° C. or less;

(ii) then executing rapid cooling to room temperature at a rate of 100° C./s or more; and (iii) further holding at 240° C. or less for 300 s or less.

9. A method for manufacturing the high strength cold-rolled steel sheet according to claim 6, the method comprising:

(i) holding a steel sheet, which has been obtained by subjecting a steel slab satisfying the component composition to hot rolling and cold rolling, for 30 s or more and 1,200 s or less after heating at an Ac3 point or more and 930° C. or less;

(ii) then executing rapid cooling to room temperature at a rate of 100° C./s or more; and (iii) further executing a heat treatment of holding at 240° C. or less for 300 s or less.

10. The method according to claim 7, further comprising: before said holding (i), (iv) holding the steel sheet which has been subjected to the cold rolling at the Ac3 point or more and 930° C. or less for 30 s or more and 1,200 s or less, and (v) thereafter rapidly cooling the steel sheet to room temperature at a rate of 100° C./s or more.

11. The method according to claim 8, further comprising: before said holding (i), (iv) holding the steel sheet which has been subjected to the cold rolling at the Ac3 point or more and 930° C. or less for 30 s or more and 1,200 s or less, and (v) thereafter rapidly cooling the steel sheet to room temperature at a rate of 100° C./s or more.

12. The method according to claim 9, further comprising: before said holding (i), (iv) holding the steel sheet which has been subjected to the cold rolling at the Ac3 point or more and 930° C. or less for 30 s or more and 1,200 s or less, and (v) thereafter rapidly cooling the steel sheet to room temperature at a rate of 100° C./s or more.

13. The high strength cold-rolled steel sheet according to claim 1, wherein component composition of the high strength cold-rolled steel sheet is free from Ti.

14. The high strength cold-rolled steel sheet according to claim 1, wherein component composition of the high strength cold-rolled steel sheet is free from Nb.

* * * * *